US005247824A

United States Patent [19]

Horan

[11] Patent Number: 5,247,824

[45] Date of Patent: Sep. 28, 1993

[54] APPARATUS FOR A RESHAPING METAL PANELS OF AUTOMOBILES OR MOTOR VEHICLES OR THE LIKE

[75] Inventor: Gerald P. Horan, Unionville, Canada

[73] Assignee: Chart Industries Ltd., Pickering, Canada

[21] Appl. No.: 936,340

[22] Filed: Aug. 28, 1992

[51] Int. Cl.[5] ..... B21D 1/12

[52] U.S. Cl. ..... 72/308; 72/705

[58] Field of Search ..... 72/308, 422, 447, 457, 72/705

[56] References Cited

U.S. PATENT DOCUMENTS 4,761,987 8/1988 Gamauf ..... 72/705

4,825,679 5/1989 Cortinovis ..... 72/705

OTHER PUBLICATIONS

Chart Accessories For Collision Repair Brochure, May 1991.

*Primary Examiner*—Lowell A. Larson

*Attorney, Agent, or Firm*—Marcelo K. Sarkis; Neil H. Hughes; Ivor M. Hughes

[57] ABSTRACT

An apparatus for reshaping metal panels or the like of motor vehicles or automobiles, the apparatus comprising;

a first internally threaded circular in perimeter nut, having two ends whereon one end thereof there is located a multiplicity of substantially circular grooves radially extending outward to the perimeter of said nut to grasp one side of a metal panel in use, a second internally threaded circular in perimeter nut, having two ends whereon one end thereof there is located a multiplicity of substantially circular grooves radially extending outward to the perimeter of said nut complimentary to said grooves radially extending outward to the perimeter of the first nut, to grasp another side of a metal panel in use, a hollow externally threaded shaft, having two ends, to receive the first and second nut, said hollow portion of said shaft to receive pulling means to be applied to said apparatus and to allow said nuts to rotate with said shaft about said pulling means in use, and two metal fingers projecting from at least one nut end distant said end having said circular grooves thereon for aiding a user in tightening and loosening said nut on said threaded shaft, wherein the substantially circular nut reduces the imbalance of forces applied to said metal when a pulling force is applied thereto, decreasing the possibility of tearing or damaging the metal panel during reshaping.

7 Claims, 4 Drawing Sheets

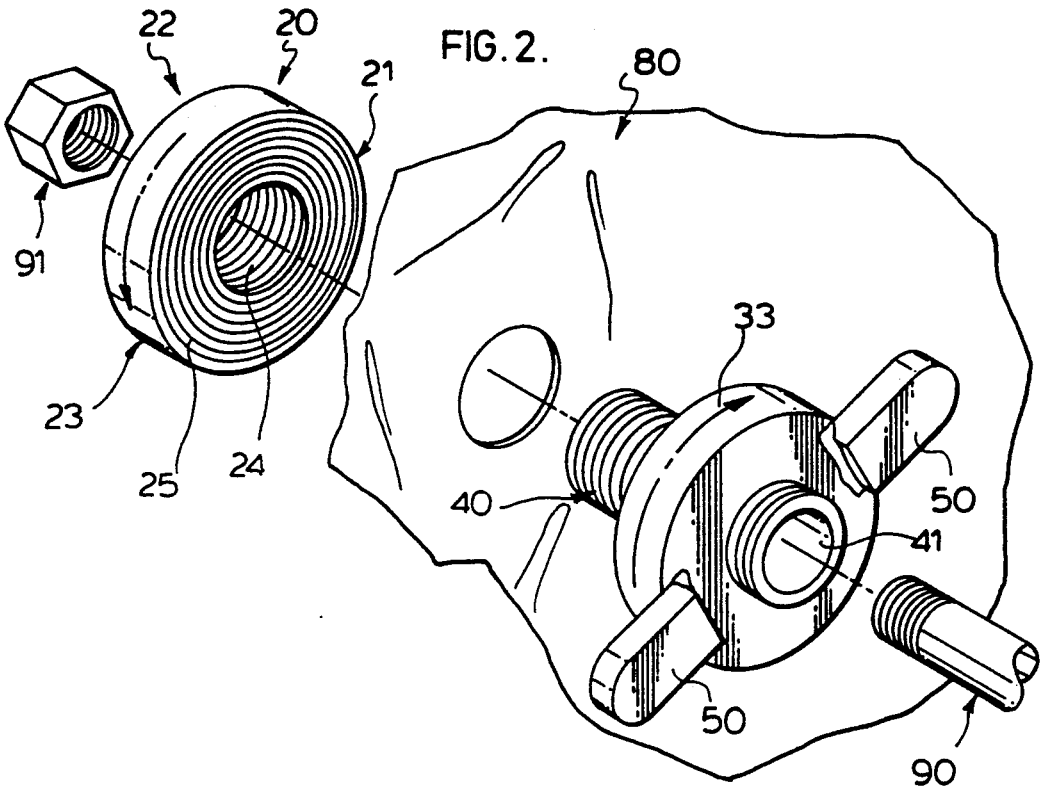
FIG. 2.
FIG. 3.
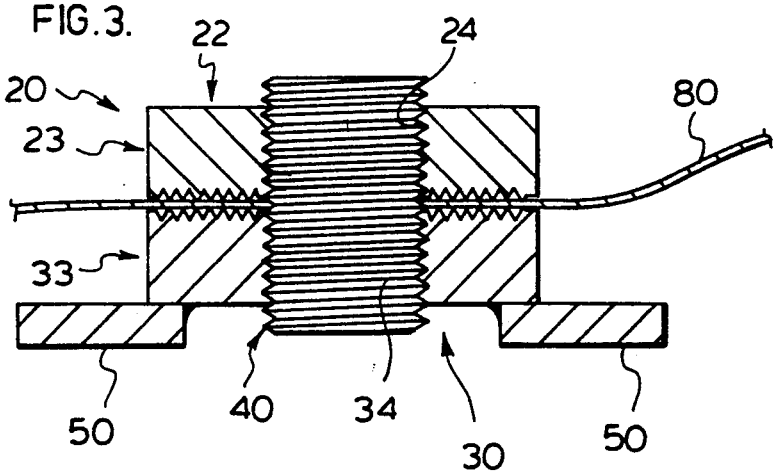

APPARATUS FOR A RESHAPING METAL PANELS OF AUTOMOBILES OR MOTOR VEHICLES OR THE LIKE

FIELD OF INVENTION

This invention relates to the reshaping of metal panels or the like incorporating an apparatus which reduces the possibility of tearing or damaging the metal panel upon reshaping thereof.

BACKGROUND OF THE INVENTION

In the field of collision damage repair to motor vehicles or the like, the current methods and apparatuses used to repair damaged metal panels commonly are clamps having square-like edges that are secured on an edge of the damaged panel, and then a pulling force is applied to straighten out the panel to its original shape. We have found that these edge clamps, the square corners thereof, have a tendency to concentrate the pulling load at the corners of the clamp, causing the metal panel to be damaged, specifically tearing near the square-like corner of the clamp, due to the weakening of the panel near the square-like corner of the clamp.

Furthermore, in the event that there is more damage to one side of the clamp than the other side of the clamp, the pulling forces become unbalanced and tend to concentrate the pulling forces on the side of the clamp that has already straightened out the panel and therefore causing the metal panel to fail and thus tear.

It is therefore an object of the invention to provide a means to reshape metal panels or the like reducing the possibility of damaging or tearing of the panel when being pulled.

It is another object of the invention to provide a means to reshape metal panels or the like which reduces the imbalance of forces on a damaged metal panel when being reshaped to its original shape.

Further objects of the invention will become apparent from a consideration of the following description.

SUMMARY OF THE INVENTION

In one embodiment of the invention there is provided an apparatus for reshaping metal panels or the like preferably motor vehicle metal panels, the apparatus comprising;

a first internally threaded nut, whose shape is substantially circular in perimeter and has two ends, where on one end thereof there is located grasping means to grasp one side of the metal panel or the like, a second internally threaded nut, whose shape is substantially circular in perimeter and has two ends, where on one end thereof there is located grasping means complimentary to said grasping means of said first nut to grasp another side of the metal panel or the like, a externally threaded shaft, having two ends, to receive the first and second nut such that the end of each nut where there is located grasping means is located adjacent the one side and the another side of the metal panel when in use, and receiving means on said threaded shaft, preferably a hollow bore through said threaded shaft, for receiving pulling means to be applied to said apparatus when in use and preferably said receiving means allow said nuts to rotate with said shaft about said pulling means in use, such that when the apparatus is in use, the substantially circular in perimeter nuts when a pulling force is applied thereto reduces the imbalance of forces applied to said panel, decreasing the possibility of tearing or damaging the panel during reshaping.

In a preferred embodiment said grasping means comprise a multiplicity of circular grooves radially extending outward to the perimeter of each of said nuts.

In a further embodiment of the invention, at least one of said nuts further comprise integral detent means on one end thereof distant said end with grasping means thereon preferably at least one finger projecting from at least one of said nuts, to aid a user in tightening and loosening at least one of said nuts onto said shaft.

In yet another preferred embodiment of the invention, there is provided an apparatus for reshaping metal panels or the like preferably motor vehicle metal panels, the apparatus comprising;

a first internally threaded circular in perimeter nut, having two ends whereon one end thereof there is located a multiplicity of substantially circular grooves radially extending outward to the perimeter of said nut to grasp one side of a metal panel in use, a second internally threaded circular in perimeter nut, having two ends whereon one end thereof there is located a multiplicity of substantially circular grooves radially extending outward to the perimeter of said nut complimentary to said grooves radially extending outward to the perimeter of the first nut, to grasp another side of a metal panel in use, a hollow externally threaded shaft, having two ends, to receive the first and second nut, said hollow portion of said shaft to receive pulling means to be applied to said apparatus and to allow said nuts to rotate with said shaft about said pulling means in use, and two metal fingers projecting from at least one nut end distant said end having said circular grooves thereon for aiding a user in tightening and loosening said nut on said threaded shaft, wherein the substantially circular nut reduces the imbalance of forces applied to said metal when a pulling force is applied thereto, decreasing the possibility of tearing or damaging the metal panel during reshaping.

Further objects and embodiments of the invention will become apparent from reading the following detailed description of the invention in a preferred embodiment.

BRIEF DESCRIPTION OF THE DRAWINGS

The invention will now be illustrated with respect to the following drawings illustrating embodiments of the invention in which:

FIG. 2 is an exploded view of the invention in a preferred embodiment when being inserted on to a metal panel.

FIG. 3 is a side cross sectional view of the invention in a preferred embodiment.

DETAILED DESCRIPTION OF PREFERRED EMBODIMENTS OF THE INVENTION

Figure 1:
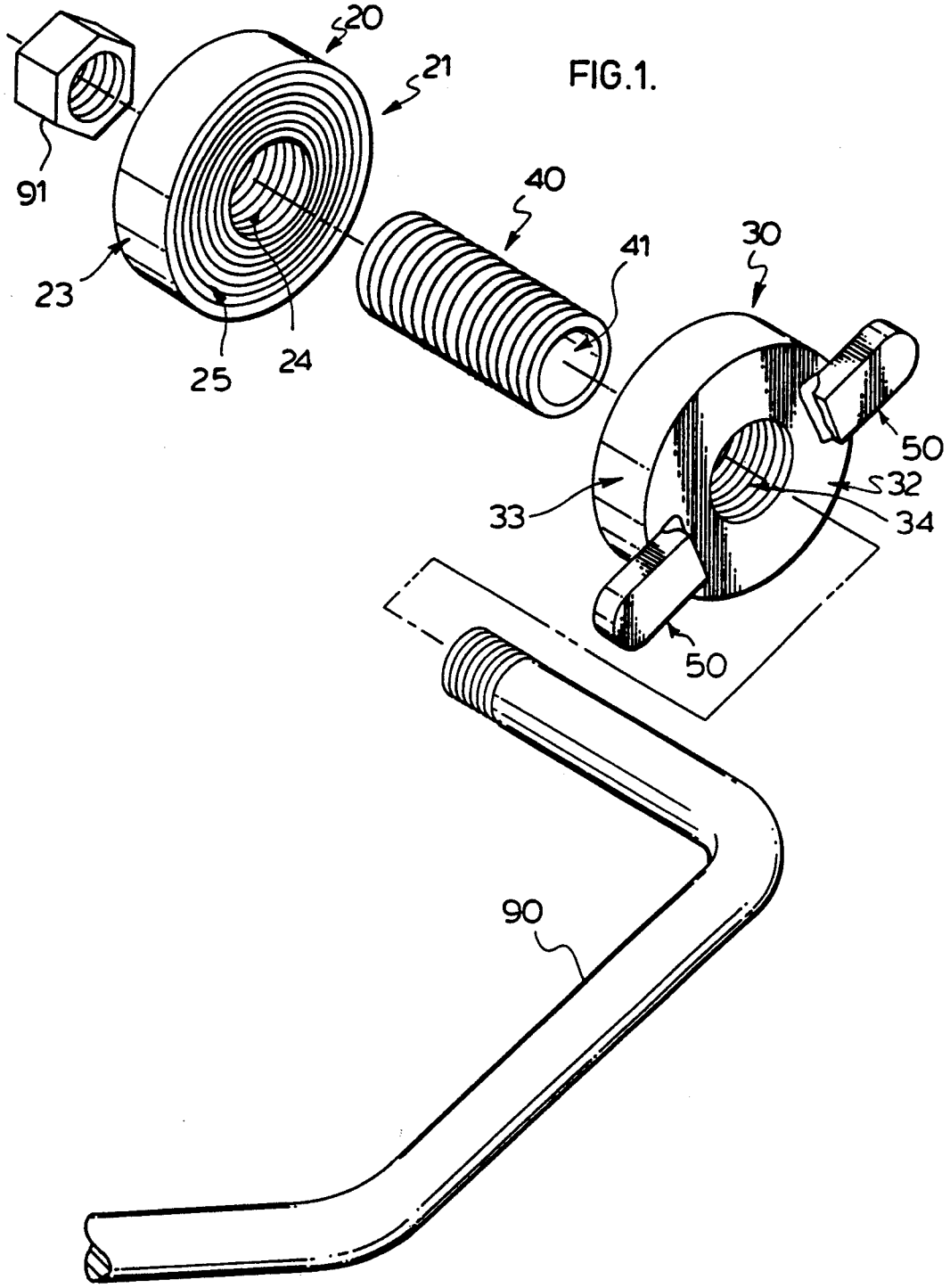
FIG. 1 is an exploded view of the invention in a preferred embodiment.

Referring now to the Figures, the invention is generally denoted as 10 having a first substantially circular nut 20 and a second substantially circular nut 30, joined to each other by a hollow shaft 40. The material of manufacture of the invention 10 is a suitable metal or metal alloy or the like which can withstand excessive pulling forces thereon. The nut 20 has two ends 21, 22 and a side 23. it also has a threaded bore 24. On end 21, there is seen a series of circular grooves 25 radially extending outwards from the surface near the bore 24 proximate the side 23 of the nut 20. Similarly, nut 30 has two ends 31, 32 and a side 33, and also a threaded bore 34 extending from one end 31 to the other end 32. On the surface of end 31, there are a series of circular grooves 35 radially extending outwards from the surface end 31 near the bore 34 to proximate the side 33 of the nut 30. The circular grooves 25 on the nut 20 are complementary to the circular grooves 35 on the nut 30, in order to grasp the metal panel when applying a pulling force thereto. The nut 30, also has on end 32 two fingers 36 to aid a user in tightening or loosening the nut 30 onto the threaded shaft 40. The threaded shaft 40 in the preferred embodiment has a bore 41 running the length of the shaft 40. the bore 41 is used to receive a pulling device to exert a pulling force on the invention 10 when in use, and to allow the nuts 20 and 30 to rotate with the shaft 40 if the pulling force direction is needed to be changed or if there is an imbalance of forces on the metal panel when a pulling force is applied thereto.

Figure 4:
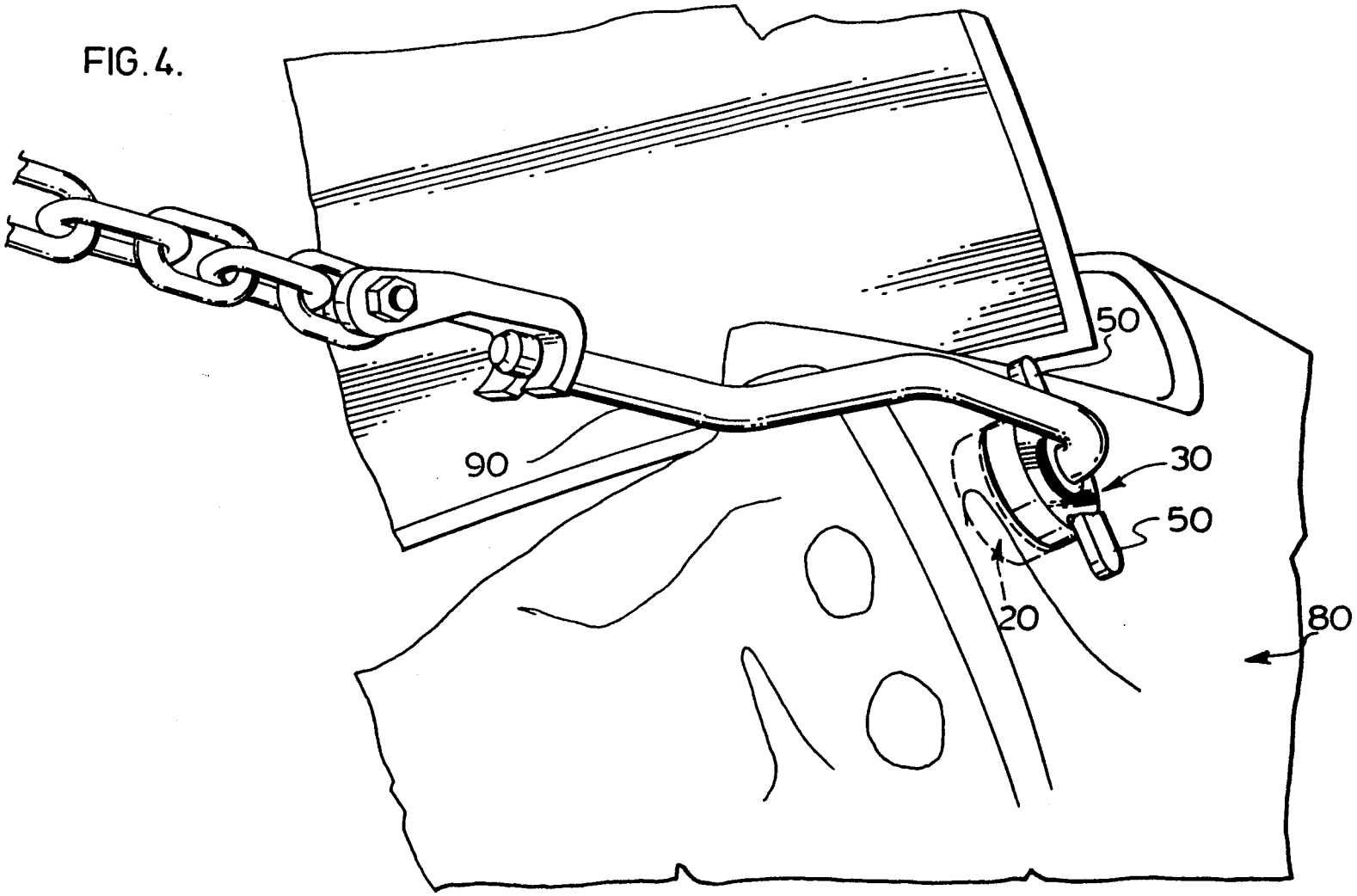
FIG. 4 is a perspective view of the invention in a preferred embodiment.
Figure 5:
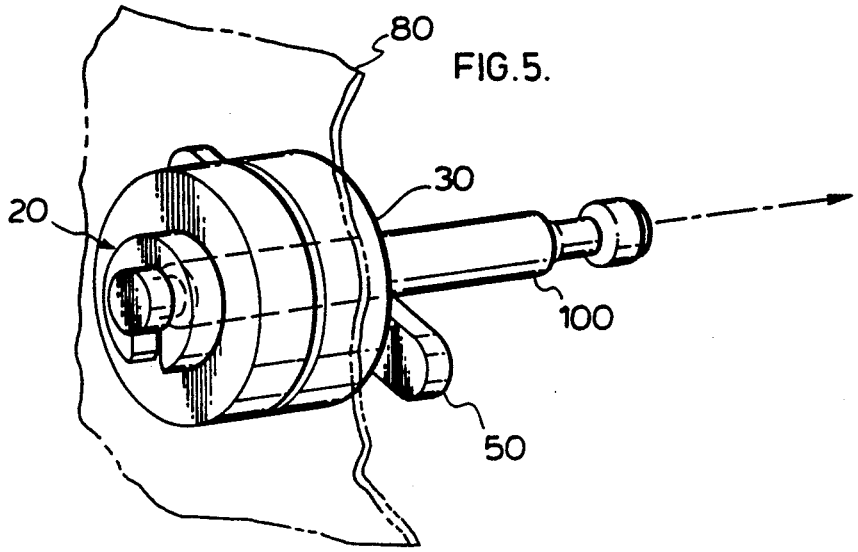
FIG. 5 is a perspective view of the invention in a preferred embodiment.
Figure 6:
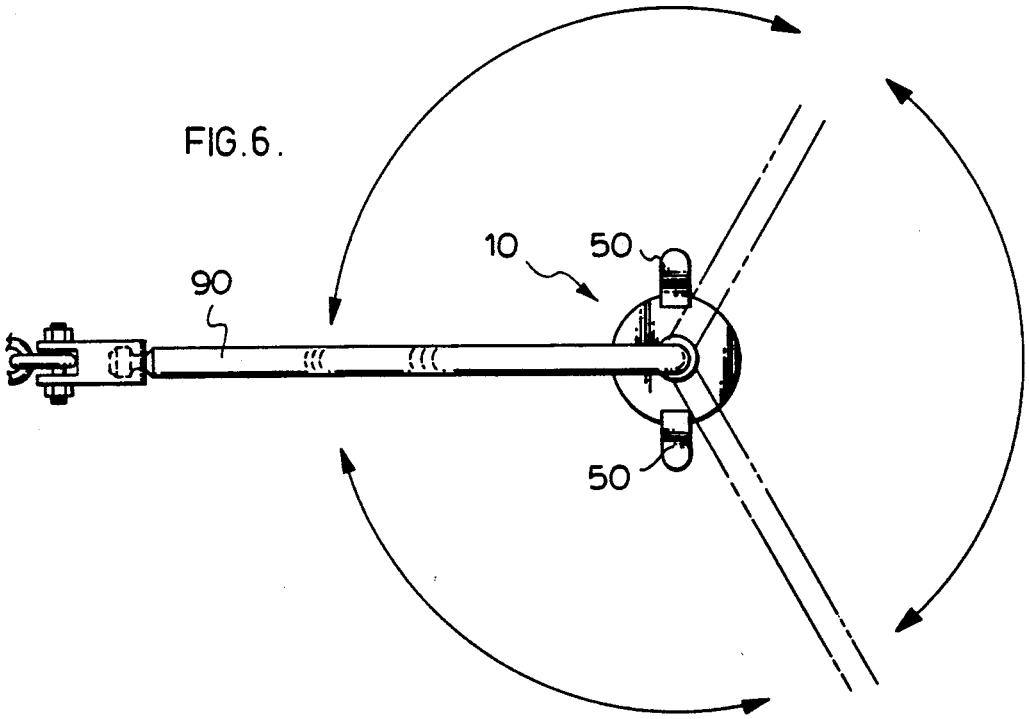
FIG. 6 is a plan view of the invention showing the rotation capability of the invention with the pulling device.

In use, the user would thread on one nut onto one end of the threaded shaft 40 as best seen in FIG. 2. The user would then proceed to insert the threaded shaft 40 having the first nut threaded thereon, through a hole (existing or made for this purpose) near the damaged area of an automobile or motor vehicle metal panel 80. The user would then thread a second nut onto the threaded shaft 40 such that the metal panel 80 would be sandwiched by the nut end 21 of nut 20 having a series of circular grooves 35 thereon and the nut end 31 of the nut 30 having a series of complementary circular grooves 45 to the grooves 35, and then tighten the nut 30 by using the fingers 50 thus securely grasping the panel 80 between the two nuts 20 and 30 as best seen in FIG. 3. The user would then insert a pulling device, in this case a finger hook 90 as best seen in FIGS. 1 and 4, in through the bore 41 of the shaft 40 held in place by a nut 91, such that the finger hook 90 is free to rotate about said invention 10 as best seen in FIG. 6. The user would then apply a pulling force on the finger hook 90, which in turn pulls the invention 10 substantially along the plane of the metal panel 80, causing the metal panel to straighten out to its original form. Furthermore, as best seen in FIG. 5, a front pulling shaft bar 100 is inserted through the shaft bore 41 to apply a pully force substantially normal to the plane of the metal panel 80. The circular nuts 20 and 30 while grasping the panel 80, reduce the chance of tearing or damaging of the panel 80 due to imbalanced forces on the panel 80 by spreading out the tensile forces on the panel 80 in a radial movement and not focusing the tensile forces on one particular point on the metal panel 80 which may cause the panel 80 to tear and be damaged even further. Therefore, since the forces are spread out radially over the length of the metal panel 80, due to the circular configuration of the nuts 20 and 30, the panel 80 is less likely to tear when undergoing repair (i.e. pulling thereon).

As many changes can be made to the preferred embodiments of the invention without departing from the scope of the invention; it is intended that all material contained herein be interpreted as illustrative of the invention and not in a limiting sense.

The embodiments of the invention in which an exclusive property or privilege is claimed are as follows:

1. An apparatus for reshaping metal panels or the like of motor vehicles or automobiles, the apparatus comprising:

a first internally threaded nut, whose shape is substantially circular in perimeter and has two ends, where on one end thereof there is located grasping means to grasp one side of the metal panel or the like, a second internally threaded nut, whose shape is substantially circular in perimeter and has two ends, where on one end thereof there is located grasping means complimentary to said grasping means of said first nut to grasp another side of the metal panel or the like, a externally threaded shaft, having two ends, to receive the first and second nut such that the end of each nut where there is located grasping means is located adjacent the one side and the another side of the metal panel when in use, and receiving means on said threaded shaft for receiving pulling means to be applied to said apparatus when in use, such that when the apparatus is in use, the substantially circular in perimeter nuts when a pulling force is applied thereto reduces the imbalance of forces applied to said panel, decreasing the possibility of tearing or damaging the panel during reshaping.

2. The apparatus of claim 1 where said receiving means allow said nuts to rotate with said shaft about said pulling means in use.

3. The apparatus of claim 1 where said grasping means comprise a multiplicity of circular grooves radially extending outward to the perimeter of said nut.

4. The apparatus of claim 1 wherein said receiving means comprises a hollow bore through said threaded shaft.

5. The apparatus of claim 1 wherein at least one of said nuts further comprise integral detent means on one end thereof distant said end with grasping means thereon, to aid a user in tightening and loosening at least one of said nuts onto said shaft.

6. The apparatus of claim 5 wherein said detent means comprises at least one finger projecting from said nut.

7. An apparatus for reshaping metal panels or the like of automobiles or motor vehicles or the like, the apparatus comprising;

a first internally threaded circular in perimeter nut, having two ends whereon one end thereof there is located a multiplicity of substantially circular grooves radially extending outward to the perimeter of said nut to grasp one side of a metal panel in use, a second internally threaded circular in perimeter nut, having two ends whereon one end thereof there is located a multiplicity of substantially circular grooves radially extending outward to the perimeter of said nut complimentary to said grooves radially extending outward to the perimeter of the first nut, to grasp another side of a metal panel in use, a hollow externally threaded shaft, having two ends, to receive the first and second nut, said hollow portion of said shaft to receive pulling means to be applied to said apparatus and to allow said nuts to rotate with said shaft about said pulling means in use, and two metal fingers projecting from at least one nut end distant said end having said circular grooves thereon for aiding a user in tightening and loosening said nut on said threaded shaft, wherein the substantially circular nut reduces the imbalance of forces applied to said metal when a pulling force is applied thereto, decreasing the possibility of tearing or damaging the metal panel during reshaping.

* * * * *

UNITED STATES PATENT AND TRADEMARK OFFICE

CERTIFICATE OF CORRECTION

PATENT NO. : 5,247,824

DATED : September 28, 1993

INVENTOR(S) : Gerald P. Horan

It is certified that error appears in the above-identified patent and that said Letters Patent is hereby corrected as shown below:

On the title page, Item [54]:

In the Title of the Invention, after "Apparatus For" "A" should be deleted.

Signed and Sealed this

Twelfth Day of April, 1994

Bruce Lehman

*Attest:*

BRUCE LEHMAN

*Attesting Officer*

*Commissioner of Patents and Trademarks*